United States Patent [19]

Horobin

[11] Patent Number: 4,894,969

[45] Date of Patent: Jan. 23, 1990

[54] INSULATING BLOCK FORM FOR CONSTRUCTING CONCRETE WALL STRUCTURES

[75] Inventor: David D. Horobin, Anaheim, Calif.

[73] Assignee: AG-Tech Packaging, Inc., Anaheim, Calif.

[21] Appl. No.: 195,263

[22] Filed: May 18, 1988

[51] Int. Cl.[4] ..... E04C 2/04

[52] U.S. Cl. ..... 52/309.12; 52/426; 52/564; 52/593

[58] Field of Search ..... 52/426–428, 52/437, 438, 309.4, 309.12, 589, 593, 606, 564

[56] References Cited

U.S. PATENT DOCUMENTS 2,025,529 12/1935 Scudder ..... 52/589
4,439,967 4/1984 Dielenberg ..... 52/309.12
4,706,429 11/1987 Young ..... 52/426

*Primary Examiner*—James L. Ridgill, Jr.
*Attorney, Agent, or Firm*—Francis X. LoJacono

[57] ABSTRACT

An improved insulating block form for use in the construction of concrete wall structures wherein the block form is formed from expandable polystyrene material to provide a lightweight, rigid, box-like structure having a pair of oppositely disposed side walls and end walls which together define a body cavity to receive concrete therein. A plurality of transverse strut members integrally support the side walls and further define a plurality of cells. Each end wall includes a pair of inserts which are adapted to be mounted to the transverse strut member when the elongated block form is required to be cut for a particular installation. The side and end walls are further provided with interlocking members whereby they are readily stacked one above the other and side-to-side in a secure interlocked arrangement.

1 Claim, 4 Drawing Sheets

INSULATING BLOCK FORM FOR CONSTRUCTING CONCRETE WALL STRUCTURES

BACKGROUND OF THE INVENTION

1. Field of the Invention

The present invention relates generally to interlocking building blocks for concrete structures, and more particularly to a new and improved interlocking block form to aid in the building of various concrete structures such as walls and the like, wherein concrete is poured into the body cavity of the block form and thereby becomes a part of the permanent wall structure of a building.

2. Description of the Prior Art

There is a problem in the prior-art in that there do not exist suitable block forms that include all of the necessary elements and configurations that are required to meet the strict adherence to sound constructive practices and guidelines in the construction of concrete wall structures and the like. This is particularly an acute problem when a structure is to employ a hollow-type block form that consists of a synthetic plastic material that must withstand the high stress placed upon the walls of the block form as concrete is being poured therein.

There are many known devices and block systems that have been employed and are presently being used in building wall structures in attempting to solve many structural problems without causing limitations in use as well as restrictions in applications to particular situations or circumstances. However, there is still a need for a new, novel arrangement of a concrete-block form that can become more universally accepted in the industry. Accordingly, it is felt that the present invention overcomes many of the faults of known block forms, particularly those forms that consist of synthetic plastic material.

As an example of various known wall-forming blocks, attention is directed to the following U.S. patents.

Pat. No. 3,552,076 discloses a self-supporting concrete form of rigid, low-density, foamed plastic adapted to be left in place to provide insulation for a wall formed by such forms which are filled with concrete. The forms have vertical cavities extending therethrough and longitudinally extending channels so as to provide vertical columns of concrete interconnected by integral horizontal concrete beams.

Pat. No. 3,782,049 also discloses a wall-forming block made of foamed plastic material and having vertical openings and upwardly opening channels extending along their upper edges, which are formed with preformed rigid sheets bonded to their opposite faces, with furring strips secured to the inner faces of the sheets and embedded within the plastic.

Pat. No. 4,439,967 discloses formwork elements for building purposes having a hollow block configuration produced from a hard-foam resin material, and adapted to be filled with concrete to establish a rigid wall having insulating properties.

Pat. No. 4,706,429 discloses a modular, synthetic-plastic, concrete-form structure which comprises a pair of modular, concrete-forming panels that are interconnected by a plurality of plastic cross-ties that slidably engage the oppositely positioned side panels. The side panels also include end panels which are used as end closures to confine the concrete within the modular constructed form.

SUMMARY OF THE INVENTION

The present invention is formed from an expandable polystyrene material which is a closed-cell, lightweight, cellural plastic that is readily molded into various designed shapes by means of steam and pressure.

Accordingly, there is defined a concrete-block form having oppositely disposed side walls and transverse end walls. The end walls include upper and lower insert members which are removable when required. A plurality of transverse strut walls are also integrally formed as part of the block structure and are adapted to receive the upper and lower insert members when the block form is divided into different lengths, as required. Interlocking tongue-and-groove rails are formed along the upper longitudinal edges of the side walls as well as the upper edge of the upper insert member. The lower longitudinal edge of each side panel includes a longitudinal groove that corresponds to the upper interlocking tongue whereby the block forms can be stacked and interlocked to define a wall structure. The block forms are generally rectangular in shape wherein the side walls and end walls define a body cavity which is divided into a plurality of cells adapted to receive concrete therein.

It is, therefore, an important object of the present invention to provide a monolithic concrete-block form that is an improvement over the art and is capable of being used in structures that have been limited to the use of known synthetic or plastic block forms.

It is another object of the invention to provide a concrete-block form that consists of expandable polystyrene material which is lightweight but rigid in structure, and is adapted to withstand the internal force created by the concrete when it is poured into the body cavity thereof.

Still another object of the invention is to provide a block form of this type that includes means for interlocking stacked forms without the need for mortar or any other binder interposed between the juxtaposed block forms in order to erect a structure.

A further object of the present invention is to provide a device of this character that is so designed that it is safe and easy to work with, allowing unskilled workers to be employed in building wall structures.

A still further object of the present invention is to provide a concrete-block form that is scored with equally spaced cutting seams to allow the block form to be readily cut to a specific length, as needed.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purposes of illustration only and not limitation, there is illustrated.

DESCRIPTION OF THE PREFERRED EMBODIMENT

Figure 1:
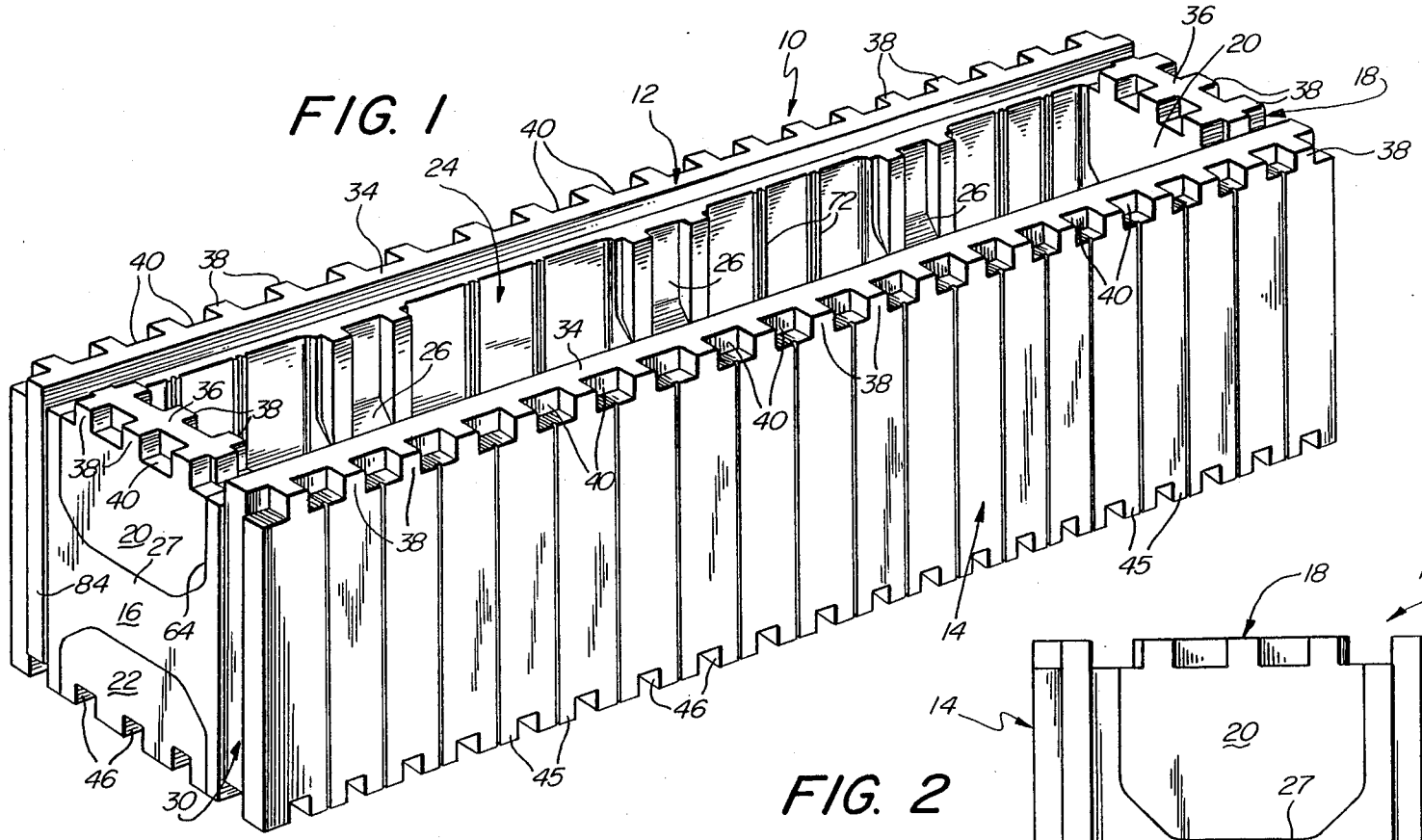
FIG. 1 is a perspective view of the present invention showing the expandable, polystyrene, concrete-block form in its typical full length configuration.
Figure 2:
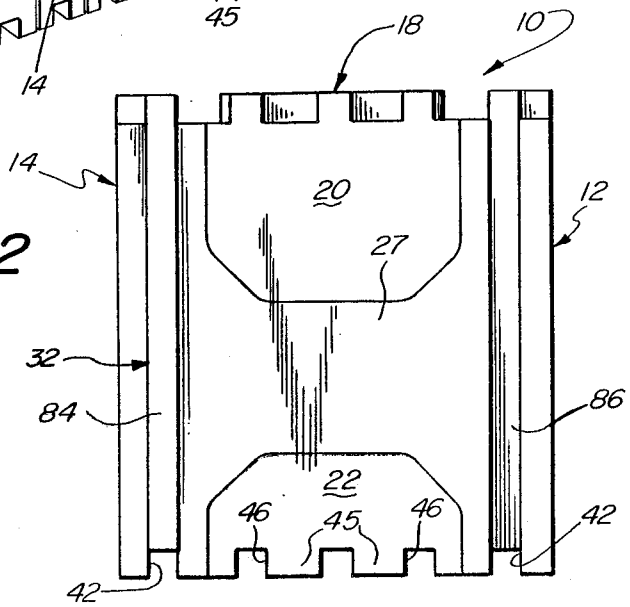
FIG. 2 is an end view of the side now seen in FIG. 1.
Figure 3:
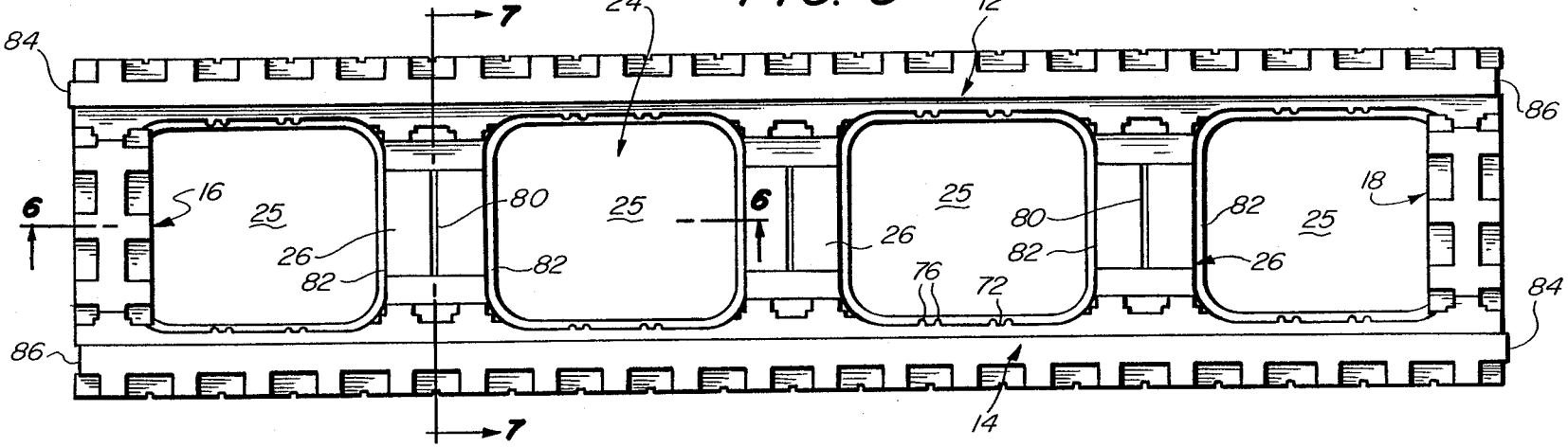
FIG. 3 is a top-plan view thereof showing the body cavity having a plurality of cell structures defined by transverse strut members.

Referring more particularly to the drawings, there is shown a monolithic concrete-block form, generally indicated at 10, having a substantially elongated body structure defined by oppositely disposed side walls 12 and 14, and end walls designated generally at 16 and 18. Each end wall includes a pair of removable inserts 20 and 22—insert 20 indicating the upper one and insert 22 the lower one. A more detailed description of the inserts and their uses will follow hereinafter.

Walls 12, 14, 16 and 18 define a box-like structure which is made from an expandable polystyrene or like synthetic material having an elongated body cavity, indicated generally at 24. The body cavity is further defined by a plurality of cell sections 25 which are provided by a plurality of transverse strut members 26. Each strut member is adapted to receive and support upper and lower inserts 20 and 22, respectively.

Interlocking means are also provided whereby the concrete-block forms are readily stackable, one on top of the other, without the need for mortar or any other binder prior to pouring concrete within the body cavities. Generally, there are two types of interlocking means—one for stacking the forms, generally indicated at 30, and one for interlocking the forms end-to-end, indicated at 32. More specifically, interlocking means 30 comprises an elongated rail 34 formed along the upper longitudinal edge of each side wall and end wall alike. That is, each insert 20 of end walls 16 and 18 includes an interlocking rail member 36. The oppositely disposed rail members 34 and 36 are further formed with lateral locking arm members 38 which more effectively define the sockets 40.

Figure 4:
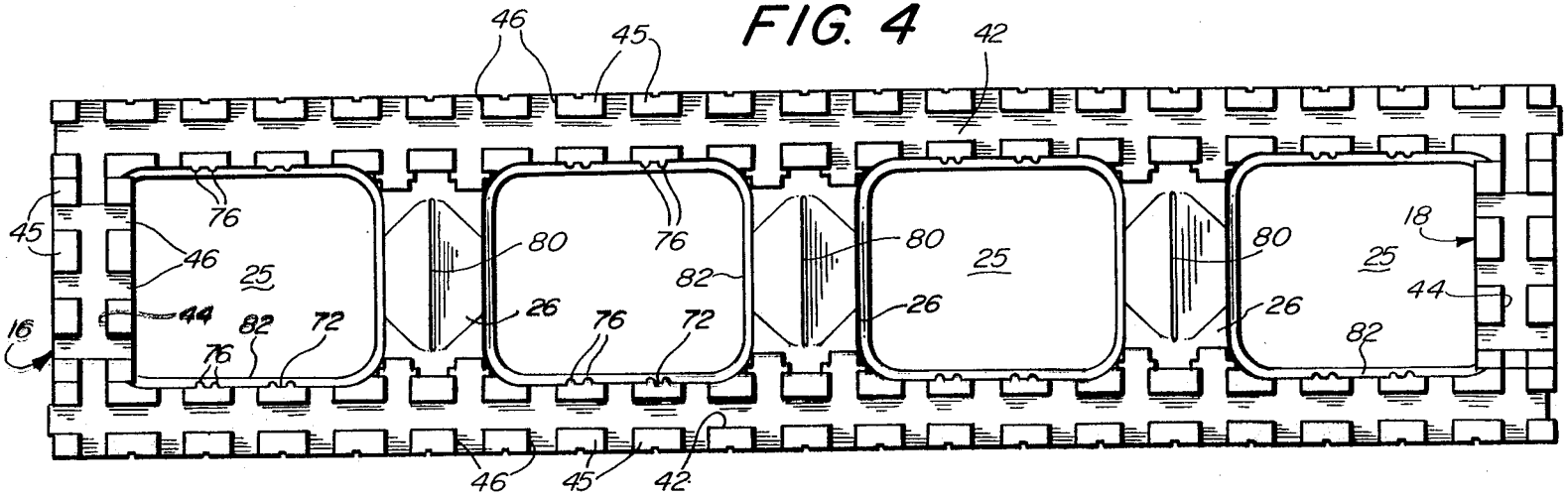
FIG. 4 is a bottom-plan view of the present invention.
Figure 5:
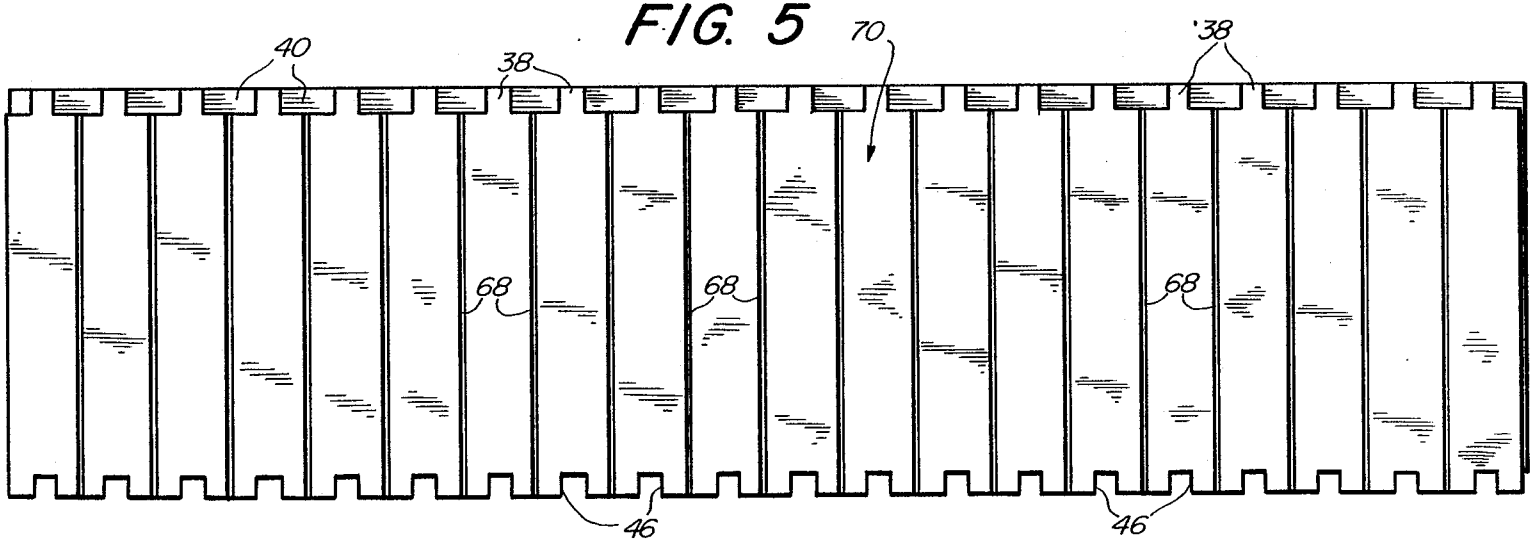
FIG. 5 is a side-elevational view of the side not shown in FIG. 1, illustrating the vertically disposed cutting grooves which are aligned with cutting grooves on the opposite side thereof.
Figure 8:
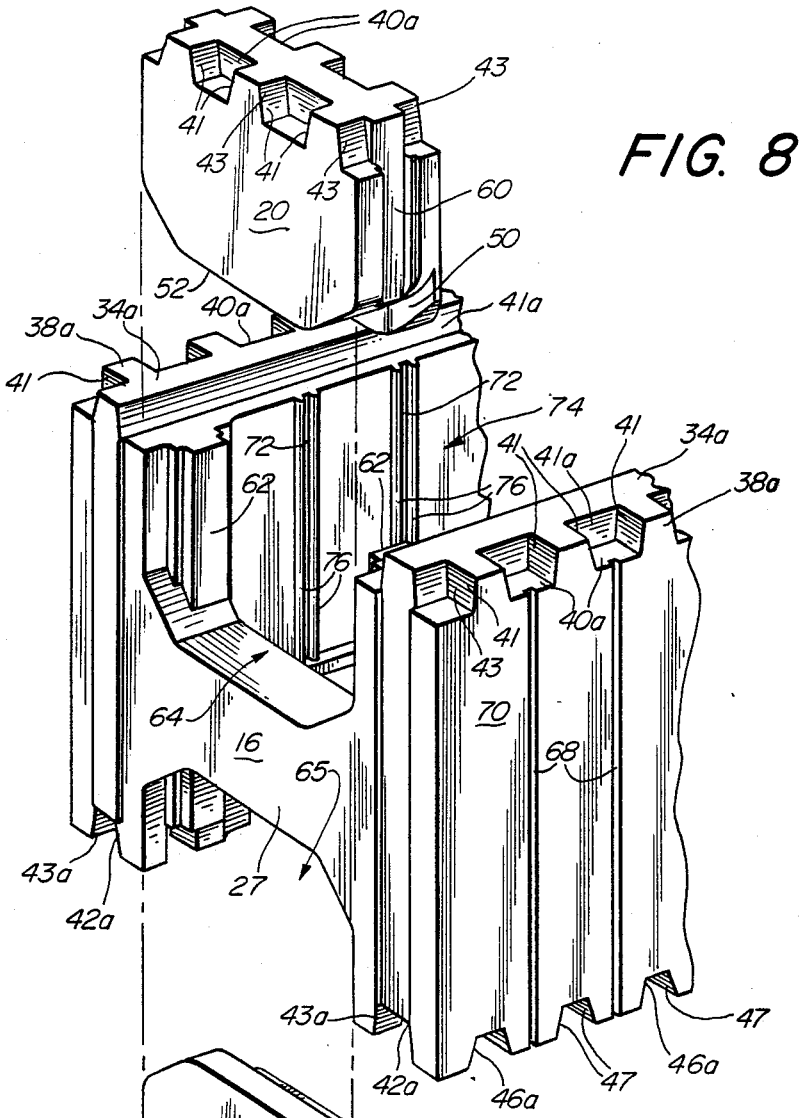
FIG. 8 is an exploded view of one end of an alternative arrangement of the block form and the associated upper and lower insert members.
Figure 9:
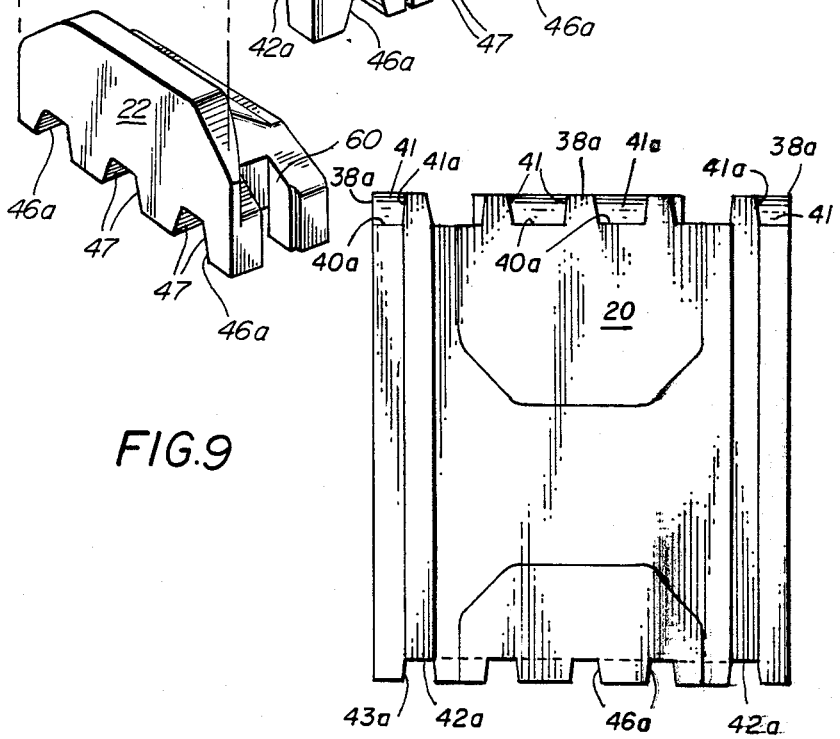

In order to form a positive interlocking arrangement, the lower longitudinal edges of the block body are formed with corresponding channels 42 (better seen in FIG. 4). Channel 42 extends the full length of each side wall 12 and 14, and is indicated at 44 in the outer edge of each bottom insert member 22, as seen in FIG. 4. Here too, channels 42 and 44 are provided with laterally extending channels 46 that define post members 45. Accordingly, when forms 10 are stacked, rails 34 and 36 are positioned in channels 42, and lateral arm members 38 are received in corresponding lateral channels 46. It should be noted (FIG. 8) the inner surfaces or walls 41 of sockets **40*a* are formed with an inward taper from top to bottom thereof, as indicated by shade lines 43. The inner surfaces 47 of lateral channel 46*a* are also tapered as indicated by shading 47. Thus, lateral arm members 38*a* are tapered so as to be received in corresponding tapered channels 46*a*. Accordingly, the longitudinal rail member 34*a* is tapered throughout its length at 41*a* so as to firmly set in corresponding longitudinal channels 42*a* as defined by tapered surface or walls 43*a***.

Figure 7:
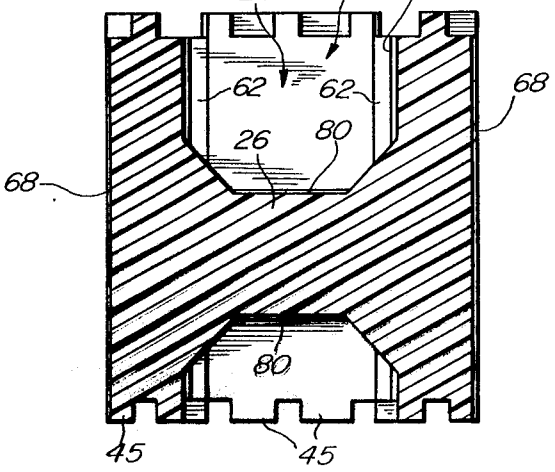
FIG. 7 is a transverse cross-sectional view taken substantially along line 7—7 of FIG. 3.
Figure 6:
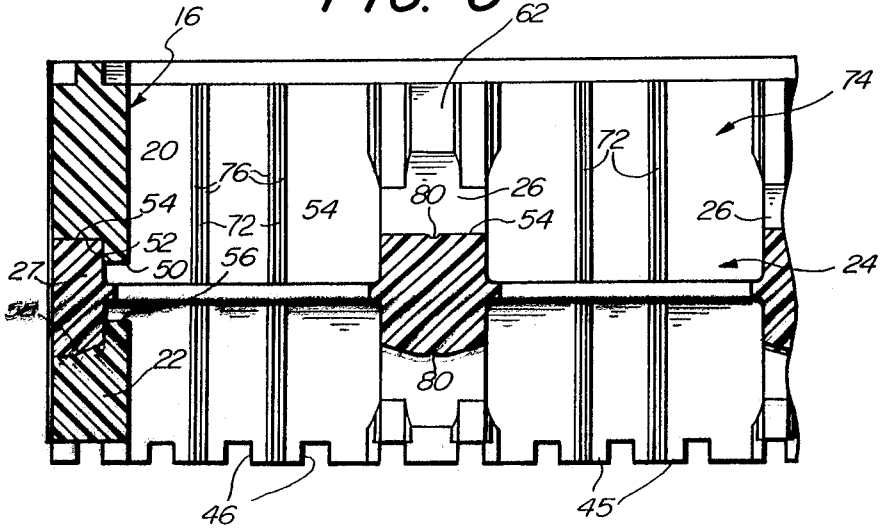
FIG. 6 is an enlarged cross-sectional view taken longitudinally along line 6—6 of FIG. 3.

Referring now to the transverse end walls 16 and strut members 26, as further shown in FIGS. 6 and 7, end wall 16 itself defines an outer strut member 27. Strut members 26 serve two functions. When block form 10 is used in its full-length configuration as herein shown, struts 26 provide the necessary support for side walls 12 and 14, and when block form 10 is cut to a selected length as required, the particular strut 26 is cut in half and is then used to define an end wall member, whereby both the upper and lower inserts 20 and 22 will fit in place thereon in the same manner as with end walls 16 and 18.

Insert 20 is formed so that its lower end is provided with a depending flange member 50 which defines a shoulder 52 that engages the flat upper edge 54 of each strut 26 and 27, with flange 50 butting against the side surface of the strut, as seen in FIG. 6. The lower or bottom insert 22 is also provided with a flange member 56 and a shoulder 58 which engage struts 27 and struts 26 when cut and used as end walls. Both the upper and lower inserts include vertical grooves 60 which lock onto matching tongue members 62 formed in the "U"-shaped openings 64 and 65 of the end walls 16 and 18. Each transverse strut 26 is also formed with tongue members 62. Hence, each insert is firmly positioned in the respective "U"-shaped opening to better define the end wall members.

Means to provide the simple cutting of the form body comprises vertical grooves 68 which are formed in the outer surfaces 70 of walls 12 and 14, and vertical grooves 72 formed on the inner surfaces 74 of side walls 12 and 14. Vertical cutting groove 72 is defined by a pair of parallel rib members 76. Additional cutting grooves 80 are provided in the surfaces of the transverse struts.

In order to provide greater stability and a reinforcement means, the inner wall that defines each cell 25 is formed with a continuous support rib 82.

To establish an interlock between the juxtaposed block end, each oppositely disposed vertical end of the side walls 12 and 14 is formed with a male projecting rib member 84 and a female recessed channel 86.

Thus, when a wall structure is being constructed by a multiplicity of concrete-block forms 10, concrete is poured into the top row of forms so that all aligned cavities and cells of the superposed rows are filled completely.

The detailed description of the invention is not intended in any way to be limited to the specific features described which are given here by way of example only, but comprehends all such variations as come within the scope of the appended claims.

What is claimed is:

1. An improved concrete block formed from expandable polystyrene material for use in building insulated concrete-wall structures wherein cavities are defined to receive concrete, comprising:

a substantially rectangular, box-like, block form having a pair of oppositely disposed, parallel, side walls and oppositely disposed end walls which define a body cavity;

interlocking means formed about the peripheral edges of said side walls and said end walls, said interlocking means having an elongated rail member formed longitudinally along the upper edge of each of said side walls and said end walls, said rail member including laterally outward extended sidearm members equally spaced apart from each other along the length thereof;

an elongated channel member formed longitudinally along the lower edge of each of said side walls and end walls, said channel member including laterally outward extended channel members, and said rail and arm members being positioned to be interlocked within respective channels of the lower edges of said walls when said blocks are stacked in a vertical position to form a building structure;

said rail and said lateral arm members defining a multiplicity of contiguous sockets adjacent the outer edges of said wall members, and said lateral channel members defining a multiplicity of contiguous post members that are arranged to be lockingly engaged in corresponding sockets when said block forms are stacked one above the other;

wherein said matching sockets and post located along the longitudinal edges of said side walls are formed with corresponding, tapered, wall surfaces for firm interlocking action between stacked block forms;

a plurality of intermediate, transverse, strut members formed with a pair of tongue members vertically located adjacent the inner surfaces of said side walls, which are integrally formed together with said oppositely disposed side walls, said transverse members including means to be selectively formed as end walls when the length of said block form is cut to a reduced length as needed;

wherein a multiplicity of cells are defined by said transverse strut member;

said end walls being defined by a centrally positioned strut member integrally formed between and adjacent the ends of said side walls, and including removable upper and lower insert members, and said insert members being further formed to be mounted to any one of a selected intermediate strut member so as to define an end wall when said block form is reduced in length;

said upper and lower insert members being formed with vertical side grooves arranged for engagment with matching tongue members formed as part of each strut member, a flanged transverse edge and a shoulder member being further included for mounting engagement with said strut member, so that when said inserts are selectively mounted to any one of said strut means an end wall structure of said block form is established; and means for cutting said block form transversely to a selective length, comprising:

a plurality of vertical grooves equally spaced along the outer surfaces of said side walls and recessed therein;

a plurality of vertical grooves formed on the inner surfaces of said side walls, said inner-surface grooves being defined by a pair of parallel rib members, whereby said inner and outer cutting grooves are aligned with each other, and wherein additional cutting grooves are formed in the upper and lower surfaces of said transverse strut member, whereby said strut member may be divided to receive said upper and lower inserts to define an end wall.

* * * * *